US012391462B2

(12) United States Patent
Schaber

(10) Patent No.: US 12,391,462 B2
(45) Date of Patent: Aug. 19, 2025

(54) CHAIR TRANSPORT SYSTEM, CHAIR AND TRANSPORT CASE

(71) Applicant: Philipp Schaber, Memmingen (DE)

(72) Inventor: Philipp Schaber, Memmingen (DE)

( * ) Notice: Subject to any disclaimer, the term of this patent is extended or adjusted under 35 U.S.C. 154(b) by 0 days.

(21) Appl. No.: 18/262,525

(22) PCT Filed: Feb. 3, 2022

(86) PCT No.: PCT/EP2022/052648
§ 371 (c)(1),
(2) Date: Jul. 21, 2023

(87) PCT Pub. No.: WO2022/167554
PCT Pub. Date: Aug. 11, 2022

(65) Prior Publication Data

US 2024/0109718 A1 Apr. 4, 2024

(30) Foreign Application Priority Data

Feb. 4, 2021 (DE) ..... 20 2021 100 571.8

(51) Int. Cl.
*B65D 85/64* (2006.01)

(52) U.S. Cl.
CPC ..... *B65D 85/64* (2013.01); *B65D 2585/648* (2013.01)

(58) Field of Classification Search
CPC .... A47C 3/20; A47C 4/00; A47C 7/40; A47C 7/407; A47C 7/48; B65D 85/00; B65D 85/64; B65D 2585/648
USPC ..... 206/326
See application file for complete search history.

(56) References Cited

U.S. PATENT DOCUMENTS 6,804,938 B2 * 10/2004 Levin ..... A47C 31/11 53/472
8,365,911 B2 * 2/2013 Oh ..... B65D 85/00 280/47.131
10,640,286 B1 5/2020 Lycourt et al.
2003/0079441 A1 5/2003 Levin et al.
(Continued)

FOREIGN PATENT DOCUMENTS

CN 207693272 U 8/2018
CN 109008372 A 12/2018
(Continued)

OTHER PUBLICATIONS

Search report for International Application No. PCT/EP2022/052648 dated May 18, 2022, 12 pages.

*Primary Examiner* — Bryon P Gehman
(74) *Attorney, Agent, or Firm* — Keith C. Rawlins, Esq.; Scheef & Stone, L.L.P.

(57) ABSTRACT

There is proposed a chair transport system which is provided for the transport of a chair, comprising a transport case and a chair, wherein the transport case has a receiving space which is delimited by side walls and an upper plate and the chair has a frame on the frame arms of which at least one rotatably supported roller is provided and the frame carries at least one seat face and, in the transport position, the chair is introduced for the most part in the receiving space and the chair is connected by means of a connection apparatus indirectly or directly to the transport case and the system is supported on the ground by means of the rollers of the chair.

13 Claims, 3 Drawing Sheets

(56) References Cited

U.S. PATENT DOCUMENTS

| | | | |
|---|---|---|---|
| 2006/0261643 | A1 | 11/2006 | Lingwall |
| 2016/0206101 | A1 | 7/2016 | Grace |

FOREIGN PATENT DOCUMENTS

| | | | | | |
|---|---|---|---|---|---|
| DE | 102008000736 | A1 * | 10/2008 | ..... | A47C 7/407 |
| IT | 102011901965107 | A1 | 1/2013 | | |
| JP | S50 102765 | U | 8/1975 | | |

* cited by examiner

CHAIR TRANSPORT SYSTEM, CHAIR AND TRANSPORT CASE

CROSS-REFERENCE TO RELATED APPLICATIONS

This application is a filing under 35 U.S.C. 371 of International Patent Application No. PCT/EP2022/052648, filed Feb. 3, 2022, which claims priority to German Patent Application No. 202021100571.8, filed Feb. 4, 2021, which applications are incorporated by reference herein in their entirety.

FIELD OF THE DISCLOSURE

The invention relates to a chair transport system for transporting a chair, and associated chair and an associated transport case.

BACKGROUND

Chairs are generally used so that a person can sit on them. Such chairs are in particular also used at events, wherein, for example, operators of sound or light mixing desks sit on chairs which are arranged in front of such desks. Accordingly, it is advantageous to transport such chairs together with other equipment for events. In this case, equipment, such as, for example, mixing desks or loudspeakers, are typically packed in suitable transport cases or are already in the form of a transport case, wherein such transport cases generally have rotatable rollers so that they can be easily pushed and also loaded onto vehicles.

It has been found that chairs during such transport operations typically represent a problem since they are less robust and cannot be as easily stored as conventional.

SUMMARY

An object of the invention is therefore to provide a proposal which enables a better transport of at least one chair.

This is achieved according to the invention with a chair transport system, a chair and a transport case according to the respective main claims. Advantageous embodiments are claimed in the dependent claims.

The invention relates to a chair transport system which is provided for the transport of a chair. A chair transport system has a transport case and a chair. The transport case has a receiving space which is delimited by side walls and an upper plate. The chair has a frame on the frame arms of which at least one rotatably supported roller is provided. The frame carries at least one seat face. In a transport position, the chair is introduced for the most part in the receiving space and the chair is connected by means of a connection apparatus indirectly or directly to the transport case. The system is supported on the ground by means of the rollers of the chair.

Using such a chair transport system, a significantly simpler transport of a chair in the context of transporting other equipment for events, such as, for example, concerts or exhibitions, is possible. The transport case is typically provided with a simple, for example, parallelepipedal outer shape so that it can be transported as with other transport cases for equipment such as mixing desks or stage lighting. As a result of the rollers of the chair, the transport case can be displaced in a simple manner on the ground, displaced in the same manner as other transport cases, and can consequently be integrated into the normal work sequence for storing and unloading such transport cases. Damage to the chair during transport is eliminated since the chair is protected by the transport case.

A transport case is in particular a stable device which is used to surround another object. Typically, the transport case is delimited by the side walls which have already been mentioned and which terminate the transport case in a stable manner in an outward direction at least at five or also at six sides. In this instance, it is also typically unproblematic for such a transport case to strike another transport case or another device, such as, for example, a boundary of a storage space of a truck since the side walls are configured for such loads. The same applies to the upper plate which has already been mentioned.

The frame arms may in particular be understood to be a portion of the frame, wherein a rotatably supported roller is typically provided on each frame arm. For example, five frame arms can be used. However, a different number can also be used. The seat face is typically supported by the frame and serves to allow an operator to sit on the chair. The frame in this instance typically transmits the force from the seat face to the frame arms and further to the rollers.

According to an advantageous embodiment, the chair transport system may have a base plate which in the transport position covers the receiving space and has at least one opening, through which a portion of the frame protrudes. As a result, the base plate can terminate the transport case in a downward direction and nonetheless the already mentioned functionality can be completely maintained. For the base plate, the same applies in principle as was mentioned further above for the side walls and the upper plate. The opening may, for example, be constructed to complement the frame or the frame arms so that it covers at least the main portion of a lower side of the transport case, but enables a protrusion of significant portions of the chair.

The invention therefore comprises two variants. In the first variant, the transport case is used without a base plate, in the second variant with a base plate.

Preferably, at least the rollers protrude downward through the at least one opening. They can thereby be displaced on the ground, which enables a particularly simple displacement or movement of the transport case.

The connection apparatus may in particular comprise at least one connection arrangement which is constructed in several pieces and the connection arrangement may in particular comprise at least a pulling portion and a hook portion, wherein the pulling or hook portion is arranged on the side wall and the hook or pulling portion is arranged on the base plate, the frame or the chair. In other words, in particular a hook portion or a pulling portion may be arranged on the chair and the complementary portion may be fitted to at least one of the side walls. The chair can thereby be reliably retained in the transport case. In particular, a plurality of such connection apparatuses can also be used. The stability can thereby be even further increased. In particular, in this manner, there may be provision for the chair and transport case no longer to be able to be displaced relative to each other, at least not without releasing the connection apparatuses.

The invention further relates to a chair, in particular for a chair transport system as described herein. The chair has a frame, on the frame arms of which at least one rotatably supported roller is provided. The frame carries at least a seat face and a backrest, wherein the backrest is connected to the seat face by means of a rotary joint and in the transport position the backrest can be folded onto the seat face. This enables it to move the chair into a transport position in which it fits particularly well into the already above-mentioned transport case of the chair transport system. The transport case can thereby be reduced in comparison with other embodiments. The joint can in particular be constructed in such a manner that the backrest and seat face can be orientated at least substantially parallel with each other when the chair is moved into the transport position.

The invention further relates to a chair, in particular a chair for a chair transport system as described herein. The chair may in particular have a frame on the frame arms of which at least one rotatably supported roller is provided in each case. The frame may in particular carry at least a seat face and a backrest. In particular, a plug connection may be provided between the backrest and the seat face and the backrest may in the transport position be arranged in a storage apparatus of the chair. In particular, the chair may have such a storage apparatus. A particularly compact transport position of the chair is thereby also enabled and is particularly suitable for transport in a mentioned transport case since a particularly small amount of space is required for this.

In particular the storage apparatus may be provided on or below the seat face or on the frame or on one of the frame arms. For example, the storage apparatus may be in the form of a retention member for the backrest which enables advantageous transport.

The chair may in particular have at least one, preferably two armrests, which may be arranged laterally beside the seat face. They may in particular increase the seating comfort but may also ensure additional stability during transport. The armrest, seat face, backrest and/or frame may in particular have a contact face, which in the transport position cooperates with the transport case. In particular, such a contact face may come directly into contact with the transport case. A play-free fit can thereby be achieved, whereby the chair and transport case can be fixed relative to each other.

The height of the backrest may in particular be equal to or less than the depth of the seat face. This enables the backrest to be folded over the seat face in such a manner that the seat face defines the dimensions in a horizontal direction, in other words the backrest does not protrude over it. Consequently, the transport can be simplified and space can be saved.

The height of the armrest over the seat face may in particular correspond at least to the thickness of the backrest. During transport the armrest can thereby represent the upper boundary of the chair and consequently protect the backrest from damage. For example, the armrest may directly adjoin the transport case.

The invention further relates to a transport case, in particular a transport case for a chair transport system as described herein. The transport case has at least one face of the upper plate or the side wall, which faces the receiving space. This may in particular have at least one receiving member which in the transport position can cooperate with a portion of the chair, for example, the contact face or the seat face, so as to fix the chair in the transport case. An advantageous transport of a chair can thereby be achieved, wherein in particular the advantages already described can be achieved. In particular, the chair and transport case can be constructed with a fixed relationship relative to each other and the transport case can protect the chair as described above.

The base plate may in particular be constructed in several pieces. This enables a simpler configuration of the base plate and a simpler adaptation to the chair or to portions of the chair which are intended to protrude through an opening of the base plate. However, a single-piece construction is also possible.

The receiving member may in particular be constructed in a U-shaped manner and be provided to receive the armrest in the transport position. This enables reliable storage of the armrest and may additionally be used to define the positional relationship of the chair and transport case during transport.

The receiving member may in particular be in the form of a recess which is arranged in the upper plate. This enables an armrest to be pushed into the recess in a particularly simple manner by the transport case being placed over the chair.

BRIEF DESCRIPTION OF THE DRAWINGS

The invention will now be described with reference to the Figures, in which.

DETAILED DESCRIPTION

Figure 1:
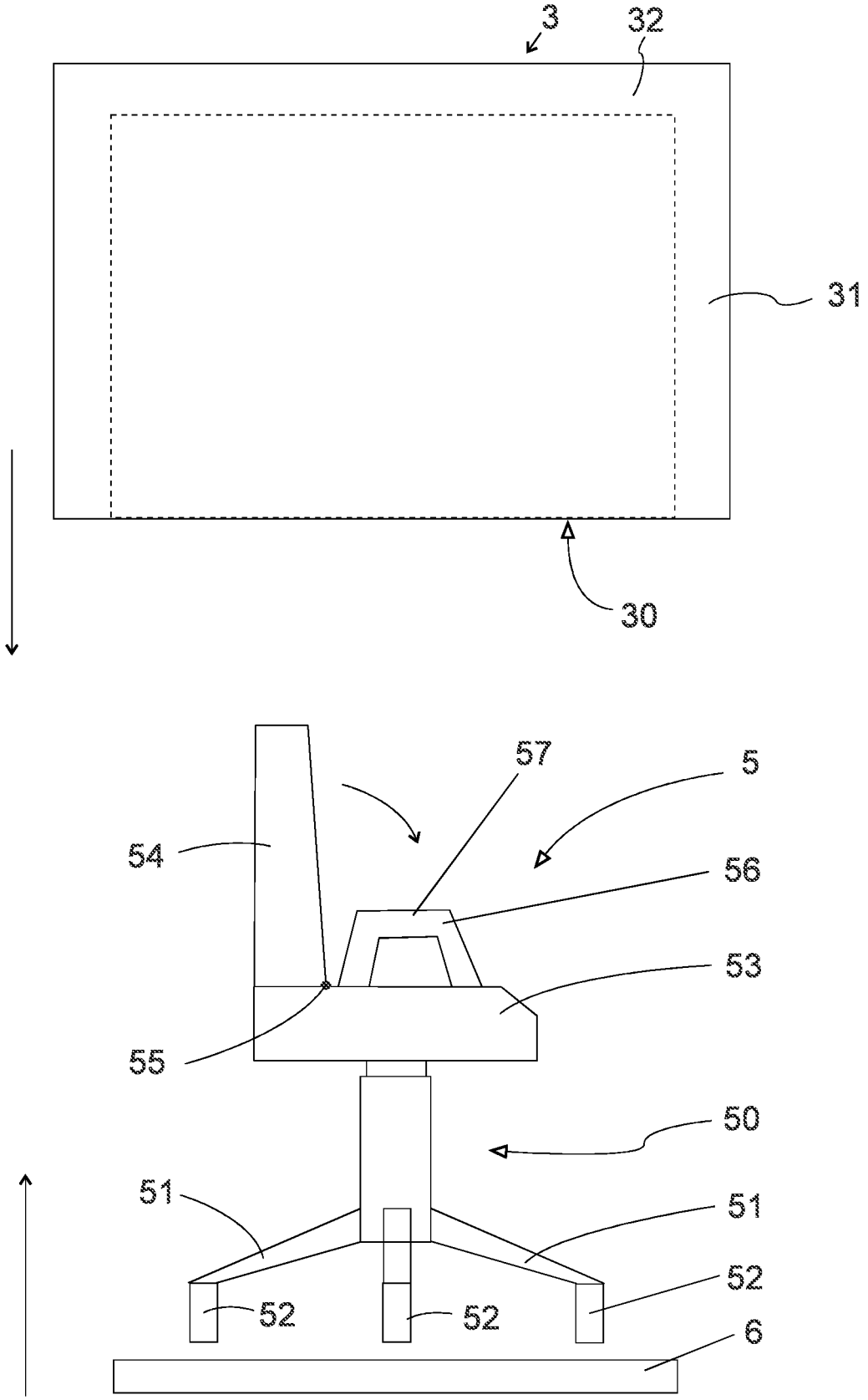
FIG. 1 shows a side view of a chair transport system comprising a chair, transport case and base plate in the not yet assembled state.

FIG. 1 shows the chair transport system 1 in the still open, not packed situation (not in the case of being transported), as arises, for example, prior to packaging and transport or after the unpacking of the chair. FIG. 1 shows centrally a chair 5 which is constructed to be used with a chair transport system 1 according to the invention. The chair 5 has a frame 50 to which a total of five frame arms 51 are fitted so as to protrude, of which three can be seen in FIG. 1. A respective rotatable roller 52 is fitted to each of the frame arms 51. The chair 5 can thereby be moved on an underlying ground and also steered since the rollers 52 can adapt to the respective travel direction.

On the frame 50 there is arranged a seat face 53 which is connected to the frame 50. This enables a person to sit on the chair 5. In this case, at the rear side there is arranged a backrest 54 which is connected to the seat face 53 by means of a rotary joint 55. This enables the backrest 54 to be folded forward so that a transport position is assumed. The backrest 54 and seat face 53 are then orientated at least substantially parallel with each other. Laterally on the side face 53, two armrests 56 are arranged, of which only one can be seen in FIG. 1. This enables the arms of a person sitting on the chair 5 to be supported. At the top on the armrest 56 there is arranged a contact face 57 which in a transport state can move into engagement with a transport case.

Below the chair 5, there is arranged a base pate 6 which has an opening which cannot be seen in FIG. 1 and through which portions of the chair 5 can extend.

Above the chair, a transport case 3 having side walls 31 and an upper plate 32 is shown. The upper plate 32 terminates the transport case 3 in an upward direction. The side walls 31 delimit it laterally at all four sides. The side walls 31 and upper plate 32 surround the receiving space 30. As can be shown by an overview of FIGS. 1 and 2, the transport case 3 can be placed on the base plate 6. Corresponding arrows are shown in the Figures. The chair 5 can thereby be covered and can thus be transported in a significantly simpler manner. In particular, the backrest 54 can be folded forward beforehand into a transport position.

Figure 3:
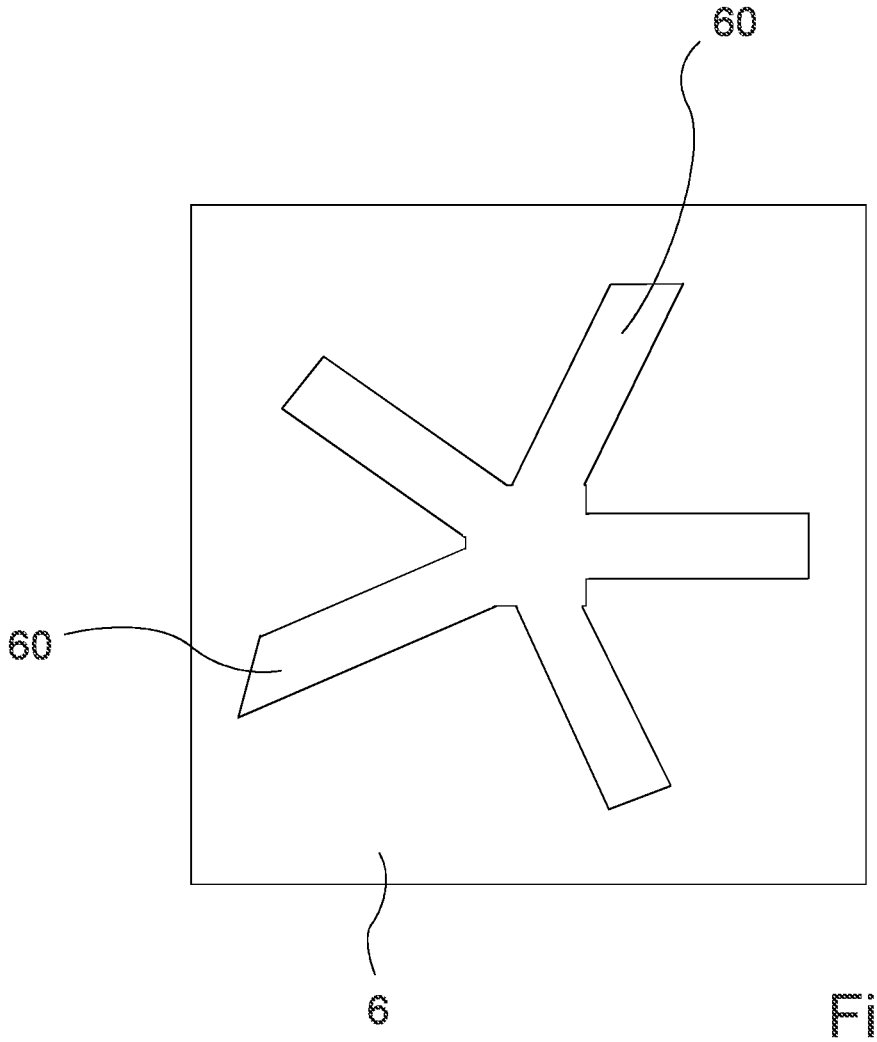
FIG. 3 shows a plan view of a base plate.

FIG. 3 shows the base plate 5 in a plan view. It can be seen in this instance that there is formed in the base pate 6 an opening 60 through which the frame arms 51 of the chair 50 can extend. The rollers 52 of the chair can also extend downward so that they protrude downward from the base plate 6. The opening 60 has in this instance the same shape as the arrangement of the frame arms 51 so that they can be completely introduced through the opening 60.

Alternatively (not shown in this instance), it is possible for the base plate 6 to have a plurality of openings only for the respective rollers 52 of the chair.

Figure 2:
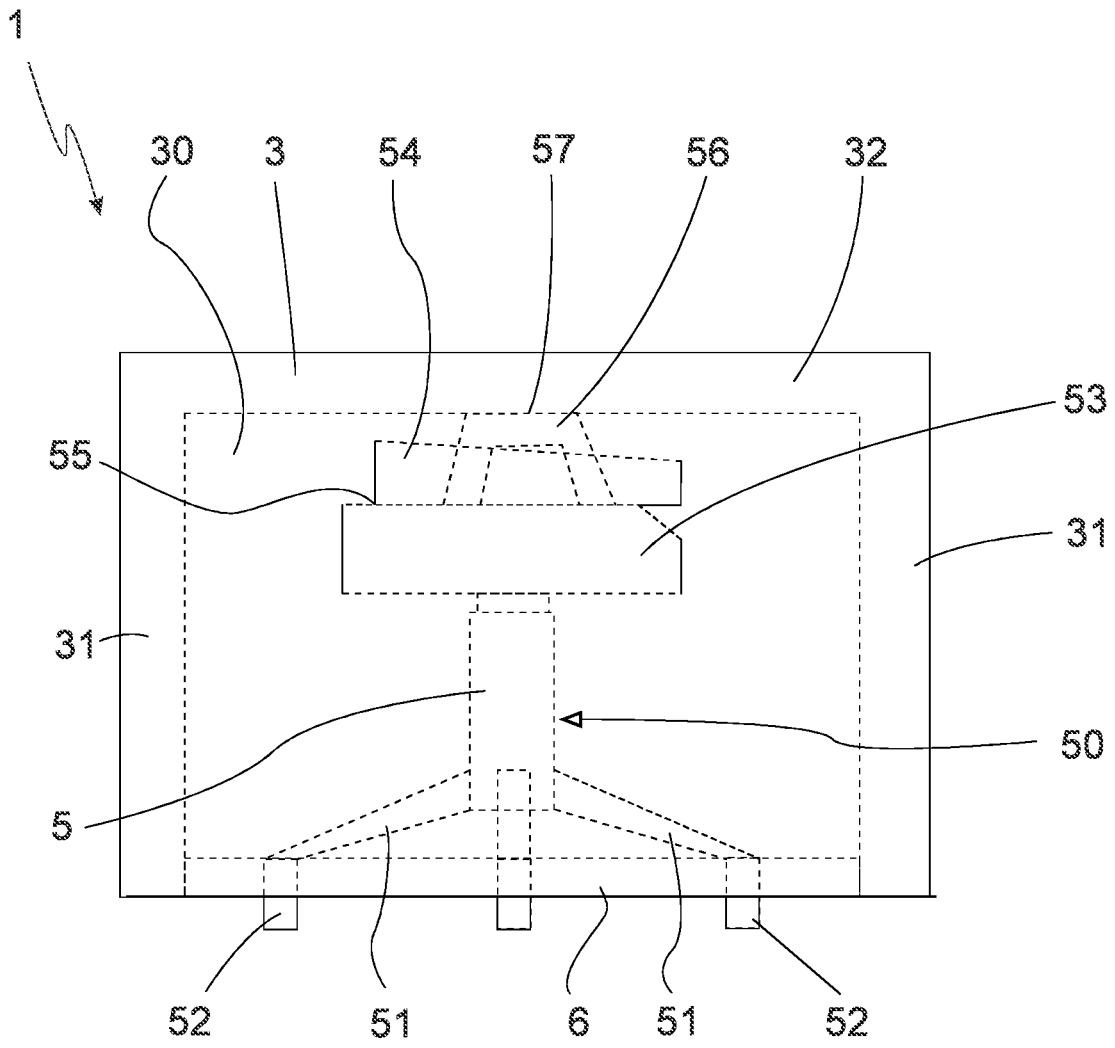
FIG. 2 shows a side view of a chair transport system comprising a chair, transport case and base plate in the assembled state (in the case of transport).

FIG. 4 shows an assembled chair transport system 1. In this instance, a chair 5 according to FIG. 1 in a transport position, a base plate 6 and a transport case 3 according to FIG. 2 are assembled in such a manner that the chair 5 is surrounded highly predominantly by the transport case 3, that is to say, protrudes into the receiving space 30, and only the rollers 52 protrude downward. Consequently, the transport case 3 can protect the chair 5 during transport and can in particular also ensure that the chair 5 can be moved and transported together with the transport case 3 as well as other transport cases which are used for events. Damage to the chair 5 during transport is thereby effectively prevented.

As can be further seen in FIG. 4, the backrest 54 rests substantially parallel on the seat face 53. This reduces the height. The contact face 57 of the armrest 56 faces in an upward direction and the upper plate 32 of the transport case 3 rests directly on the contact face 57 of the armrest 56. This enables a defined positional relationship between the transport case 3 and chair 5.

In addition, connection arrangements which are not shown and which, for example, may in each case have a pulling portion and hook portion, may be formed on the chair 5 and on the transport case 3. Consequently, the transport case 3 and the chair 5 can be even better connected to each other.

The invention is not limited to one of the embodiments described above, but can be modified in various ways.

All of the features and advantages derived from the claims, the description, and the drawings, including structural details, spatial arrangements, and method steps, may be significant for the invention both alone and in extremely varied combinations.

LIST OF REFERENCE NUMERALS

1 Chair transport system
3 Transport case
5 Chair
6 Base plate
31 Side walls
32 Upper plate
50 Frame
51 Frame arms
52 Rollers
53 Seat face
54 Backrest
55 Joint
56 Armrests
57 Contact face
60 Opening

The invention claimed is:

1. A chair transport system which is provided for transport of a chair, comprising:

a transport case;

the chair; and a base plate, wherein the transport case has a receiving space which is delimited by side walls and an upper plate, wherein the chair has a frame comprising frame arms, wherein at least one rotatably supported roller is provided on the frame arms and the frame carries at least one seat face, when in a transport position, the chair is introduced in the receiving space and the chair is connected by a connection apparatus indirectly or directly to the transport case, and the system is supported on the ground by the at least one rotatably supported roller of the chair, and when in the transport position, the base plate covers the receiving space and has at least one opening through which a portion of the frame protrudes.

2. The chair transport system as claimed in claim 1, wherein the at least one rotatably supported roller protrudes downward through the at least one opening.

3. The chair transport system as claimed in claim 1, wherein the connection apparatus comprises at least one connection arrangement which is constructed in several pieces and the at least one connection arrangement comprises at least a pulling portion and a hook portion, wherein the pulling portion or the hook portion is arranged on at least one of the side walls and the hook portion or the pulling portion is arranged on the base plate, the frame, or the chair.

4. The chair transport system of claim 1, wherein the frame carries at least a backrest, wherein the backrest is connected to the at least one seat face by a rotary joint and, when in the transport position the backrest can be folded onto the at least one seat face.

5. The chair transport system of claim 4, wherein a plug connection is provided between the backrest and the at least one seat face, and when the backrest is in the transport position, the backrest is arranged in a storage apparatus of the chair.

6. The chair transport system as claimed in claim 5, wherein the storage apparatus is provided on or below the at least one seat face, on the frame, or on one of the frame arms.

7. The chair transport system as claimed in claim 4, wherein the chair has at least one armrest which is arranged laterally beside the at least one seat face.

8. The chair transport system as claimed in claim 7, wherein the at least one armrest, the at least one seat face, the backrest, the frame, or combinations thereof has a contact face which in the transport position cooperates with the transport case.

9. The chair transport system as claimed in claim 7, wherein a height of the at least one armrest over the at least one seat face corresponds at least to a thickness of the backrest.

10. The chair transport system as claimed in claim 4, wherein a height of the backrest is equal to or less than a depth of the at least one seat face.

11. The chair transport system of claim 1, wherein at least one face of the upper plate or the side walls which faces the receiving space has at least one receiving member which, when in the transport position, cooperates with a portion of the chair of the chair transport system, so as to fix the chair in the transport case.

12. The chair transport system as claimed in claim 11, wherein the at least one receiving member is constructed in a U-shaped manner and is provided to receive an armrest of the chair when in the transport position.

13. The chair transport system as claimed in claim 11, wherein the at least one receiving member is a recess which is arranged in the upper plate.

* * * * *